United States Patent [19]

Hamano et al.

[11] Patent Number: 4,596,159

[45] Date of Patent: Jun. 24, 1986

[54] STARTING SYSTEM FOR INTERNAL COMBUSTION ENGINE

[75] Inventors: Isao Hamano; Akira Morishita; Yoshifumi Akae; Toshinori Tanaka; Kiyoshi Yabunaka, all of Himeji, Japan

[73] Assignee: Mitsubishi Denki Kabushiki Kaisha, Tokyo, Japan

[21] Appl. No.: 543,454

[22] Filed: Oct. 18, 1983

[30] Foreign Application Priority Data

Nov. 6, 1982 [JP] Japan ..... 57-168913[U]

[51] Int. Cl.[4] ..... F02N 17/00

[52] U.S. Cl. ..... 74/7 R; 290/38 R; 310/248; 318/293

[58] Field of Search ..... 318/292, 293; 310/248, 310/251, 252, 253; 74/7 R; 290/38 R, 38 A, 38 B, 38 C, DIG. 1

[56] References Cited

U.S. PATENT DOCUMENTS

| | | | |
|---|---|---|---|
| 1,880,367 | 10/1932 | Stansbury et al. | 318/292 X |
| 2,316,121 | 4/1943 | Nardone | 318/292 X |
| 2,747,116 | 5/1956 | Poole | 318/292 X |
| 3,173,043 | 3/1965 | Newill | 310/128 |
| 3,358,166 | 12/1967 | Nolan | 310/252 X |
| 4,479,394 | 10/1984 | Greenwood et al. | 74/7 R |
| 4,502,429 | 3/1985 | Ebihara | 74/7 R X |

*Primary Examiner*—William E. Tapolcai

*Attorney, Agent, or Firm*—Wenderoth, Lind & Ponack

[57] ABSTRACT

This invention relates to a starting system for an internal combustion engine comprising a prime mover, a pinion which is disposed at one end of the rotary shaft of the prime mover and which is held in rushing-in meshing engagement with a ring gear of an engine, the engine being a first load device, and a one-way clutch which is disposed at the other end of the rotary shaft of the prime mover and which generates a driving force in only a rotating direction reverse to a driving direction of the ring gear, a unidirectional turning force being applied to a second load device through the one-way clutch.

2 Claims, 5 Drawing Figures

STARTING SYSTEM FOR INTERNAL COMBUSTION ENGINE

BACKGROUND OF THE INVENTION

This invention relates to a starting system for internal combustion engines. More particularly, it relates to an improved structure of a starter which is adapted to drive a second load device.

Heretofore, there has been a system of the pertinent type as shown in FIG. 1. Referring to the figure, numeral 1 designates a starter, and numeral 2 a pinion which is mounted on the rotary shaft 1*a* of the starter 1. The pinion 2 has a built-in overrunning clutch (not shown), and it is held in meshing engagement with a ring gear 5 which is fastened to the crankshaft 4 of an engine 3. Numeral 6 indicates a spur gear which is similarly engaged with the rotary shaft 1*a* through a one-way clutch (not shown) so as to afford a unidirectional turning force reversely to that of the pinion 2. A spur gear 8 which is fastened to the rotary shaft (crankshaft) of an air pump 7 being a second load device, is held in meshing engagement with the spur gear 6 and is urged to drive by the spur gear 6.

In operation, when the starter 1 is rotated in its forward direction, the pinion 2 is rotated through the overrunning clutch (not shown). The resulting turning force is transmitted to the ring gear 5, to rotate the crankshaft 4 and to start the engine 3. After the starting of the engine 3, the pinion 2 is reversely urged through the ring gear 5. Herein, a turning force from the engine 3 is not transmitted to the starter 1 due to the action of the overrunning clutch (not shown) built in the pinion 2, so that the starter 1 is not urged to over-rotate. Next, there will be described a case of driving the air pump 7 as required. When the drive direction of the starter 1 is reversed by a built-in reversing device (not shown), the spur gear 6 is rotated through the one-way clutch (not shown). The air pump 7 is rotated through the spur gear 8 held in meshing engagement with the spur gear 6, and it pumps air as required. At this time, the turning force of the starter 1 is prevented from being transmitted to the ring gear 5 of the engine 3, under the action of the overrunning clutch (not shown) built in the pinion 2.

The prior-art system is constructed as described above, and the pinion 2 and the ring gear 5 are normally held in meshing engagement with each other. This has led to the disadvantage that the system wears away quickly.

SUMMARY OF THE INVENTION

This invention has been made in order to eliminate the disadvantage of the prior-art system as stated above, and has for its object to provide a starting system for an internal combustion engine in which a pinion is held in rushing-in meshing engagement, thereby to bring forth excellent effects to be described later.

In one aspect of performance of this invention, a starting system for an internal combustion engine comprises a prime mover, a pinion which is disposed at one end of a rotary shaft of said prime mover and which is held in rushing-in meshing engagement with a ring gear of the engine, the engine being a first load device, and a one-way clutch which is disposed at the other end of the rotary shaft of said prime mover and which generates a driving force in only a rotating direction reverse to a driving direction of said ring gear, a unidirectional turning force being applied to a second load device through said one-way clutch.

BRIEF DESCRIPTION OF THE DRAWINGS

In the drawings, the same symbols indicate the same or corresponding parts.

DESCRIPTION OF THE PREFERRED EMBODIMENT

Figure 1:
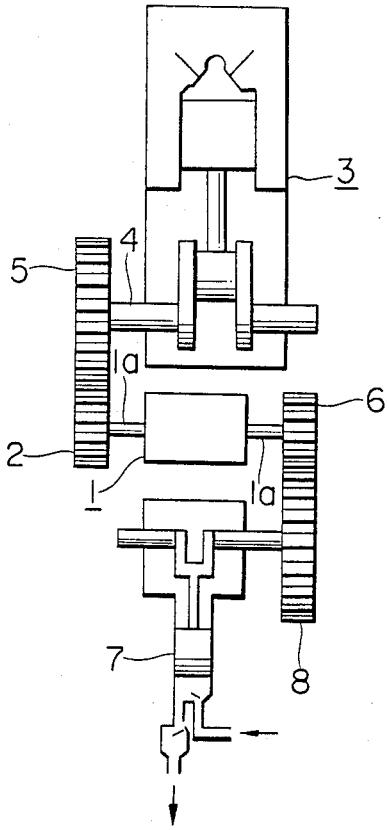
FIG. 1 PRIOR ART
FIG. 1 is an arrangement view showing a prior-art starting system for an internal combustion engine.
Figure 2:
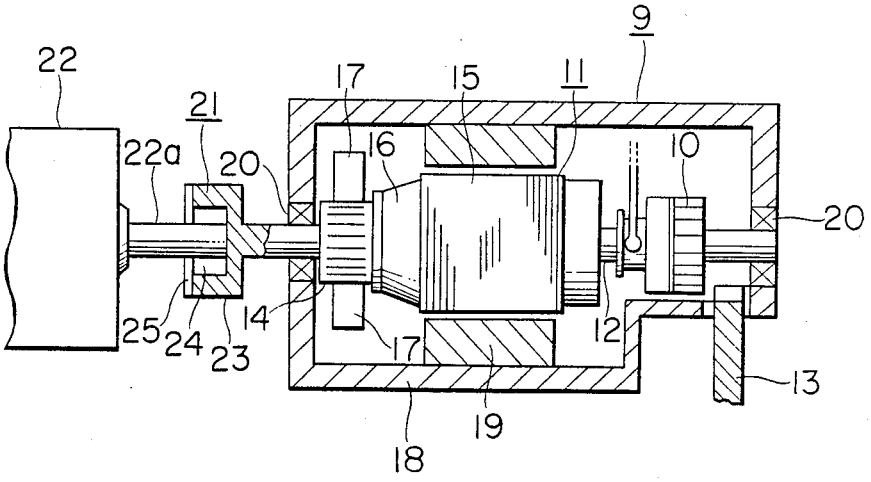
FIG. 2 is a front view, partly in section, showing a starting system for an internal combustion engine embodying the present invention.

Now, an embodiment of this invention will be described with reference to the drawings. In FIG. 2, numeral 9 designates a starter, and numeral 10 a pinion which has a built-in one-way clutch (not shown) and which is held in spline engagement with the rotary shaft 12 of an armature 11 in a manner to be slidable frontwards and backwards on a helical spline (not shown) formed in the rotary shaft 12. Numeral 13 designates the ring gear of an engine with which the pinion 10 comes into meshing engagement by rushing in, and numeral 14 the commutator of the armature 11 to which a coil 16 wound on an armature core 15 is connected. Shown at numeral 17 is a brush which is held in sliding contact with the commutator 14, and which is made of an electrographite brush material (obtained by molding a mixture consisting of carbon and copper powder, and then baking the molded compact). Numeral 18 indicates a housing. Field poles 19 are fastened on the inner peripheral surface of the housing 18, and have the function of exciting the armature 11. Ball bearings 20 are snugly fitted in holes provided in the housing 18, and the front and rear end parts of the rotary shaft 12 are journaled in the bearings. A one-way clutch 21 is installed between the rotary shaft 12 of the starter 9 and the rotary shaft 22*a* of a second load device 22, and it is principally constructed of a clutch-outer 23 secured to the rotary shaft 12, a friction roller 24 and a cover 25. Owing to the principal construction, the clutch-outer 23 comes into unidirectional turning-force engagement with the rotary shaft 22*a* through the friction roller 24 (that is, the turning force of the clutch-outer 23 is transmitted in only one rotating direction).

In operation, the pinion 10 is shifted frontwards (rightwards as viewed in the Figure) by an electromagnetic switch not shown, to come into mesh with the ring gear 13 of the engine. Thereafter, a supply voltage is applied to the brushes 17, and the armature coil 16 is energized. Upon receiving the resulting exciting forces of the field poles 19, the armature 11 generates a turning force, which is transmitted to the pinion 10 through the rotary shaft 12 and the one-way clutch (not shown) built in the pinion 10. Thus, the ring gear 13 is rotated. At this time, the one-way clutch 21 is not brought into unidirectional turning-force engagement (the turning force is brought into engagement in the direction reverse to that of the built-in one-way clutch of the pinion 10). Accordingly, the second load device 22 is not driven. Next, there will be described the case of driving the second load device 22. In this case, the condition current of the coil 16 of the armature 11 is caused to flow in the reverse direction through the brushes 17, and the armature 11 generates a turning force in the direction reverse to the above. The turning force of the rotary shaft 12 is transmitted through the one-way clutch 21 to the second load device 22, which is thus driven. Moreover, the one-way clutch 21 has the friction roller 24 installed so as to bite in the narrowing direction of a wedge-shaped space defined between the clutch-outer 23 and the rotary shaft 22*a*, so that the turning force is transmitted unidirectionally.

Figure 4:
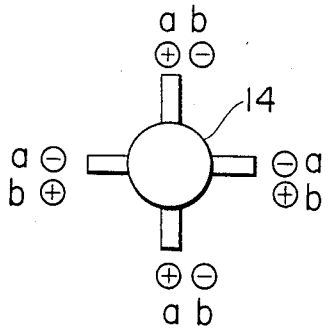
FIG. 4 is a composite side view in which line a—a and line b—b in FIG. 3 are combined.
Figure 3:
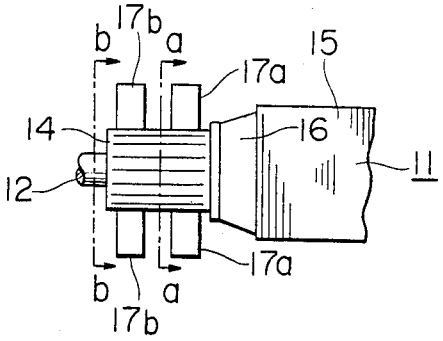
FIG. 3 is a front view, partly broken away, showing the states of brushes which slide in contact with the commutator of an armature in the embodiment of FIG. 2.
Figure 5:
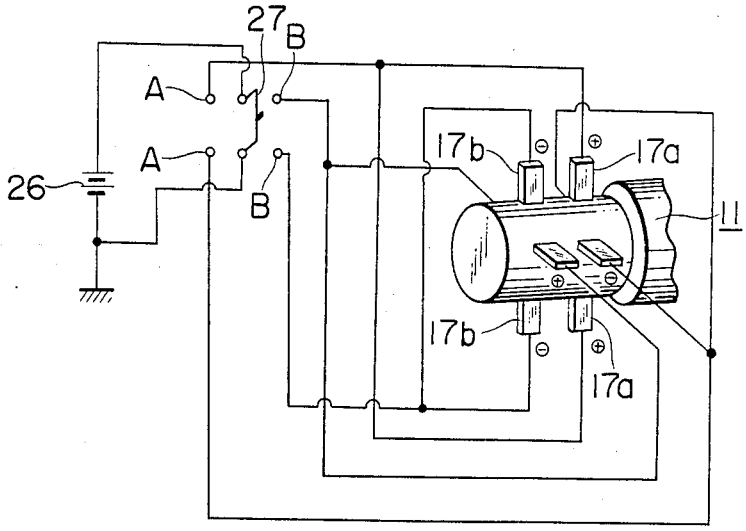
FIG. 5 is an electrical connection diagram for explaining the arrangement of FIG. 3.

A mechanism for changing-over the directions of the conduction currents of the armature has not been described in detail in the foregoing, and will now be described with reference to FIGS. 3, 4 and 5. In the figures, the armature 11 is such that first brushes 17*a* and second brushes 17*b* are installed on the commutator 14 in front and in rear along the axis thereof. As shown in FIGS. 4 and 5, the first brushes 17*a* and the second brushes 17*b* are set so as to have opposite polarities to each other, and the directions of currents to be conducted from a D.C. power source 26 to the coil 16 of the armature 11 are changed-over by a change-over switch 27 so as to become opposite to each other at contacts A and B.

As an altenative measure, the first brush 17*a* is made of a brush material having a high content of copper powder so as to reduce its electric resistance, and it is connected so as to rotate in the forward direction (the direction in which the pinion 10 is driven), while the second brush 17*b* is made of a metallized graphite brush material having a high content of carbon powder, and it is connected so as to rotate in the reverse direction (the rotating direction in which the one-way clurch 21 is brought into turning-force engagement, to drive the second load devide 22). In this case, the characteristics of the system (the armature characteristics of the motor) can be set so as to suit to the loads. For example, a high output is generated during the starting of the engine, and the current is limited during the drive of the second device (during the reversal), to suppress the sparking of the brushes and to reduce the wear of the brushes, whereby the system can be rendered long in life.

As set forth above, according to this invention, when the armature rotates in the forward direction, the pinion is brought into meshing engagement with the ring gear of the engine by rushing in, to urge the engine to start. At this time, the second load device has its power transmission path cut off by the one-way clutch, so that it does not form any additional load during the starting. When the armature rotates in the reverse direction, the second load device is urged to rotate through the one-way clutch (the pinion is prevented from rushing out by the reverse thrust action of the helical spline). If necessary, the brushes to be used during the forward rotation are made of a graphite material having a high content of copper powder, and brushes made of a graphite material having a high carbon content are used during the reverse rotation, whereby the system of improved armature characteristics and lifetime is provided. Thus the invention achieves such very desirable effects.

What is claimed is:

1. A starting system for an internal combustion engine, comprising:

a prime mover having a rotary drive shaft, said shaft having a first end and a second end opposite said first end;

a pinion mounted on said first end of said shaft so as to be reciprocally axially movable thereon between a first axial position and a second axial position, said pinion having means for meshingly engaging a ring gear of the engine for rotatively driving the ring gear only when in said first position and said shaft is rotated in a first rotational direction, and for disengaging from the ring gear by movement of said pinion from said first position toward said second position; and a one-way clutch mounted to said second end of said shaft, having means for engaging a load device for rotatively driving the load device only when said shaft is rotated in a second rotational direction opposite said first rotational direction;

said prime mover including a D.C. motor, said motor comprising a commutator, brushes in sliding contact with said commutator and means for applying a supply voltage to said brushes, said applying means comprising means for reversing the rotational direction of said shaft, said reversing means including means for changing the polarity of the supply voltage;

said brushes including at least two first brushes and at least two second brushes, said first brushes being axially aligned with said second brushes with respect to said shaft, said means for changing the polarity of the supply voltage including means for alternatively applying the voltage to said first brushes or to said second brushes, with opposite polarities to respective aligned ones of said first brushes and second brushes;

said applying means including means for energizing said motor to rotate said shaft in said first rotational direction by applying the supply voltage to said first brushes and to rotate said shaft in said second rotational direction by applying the supply voltage to said second brushes, said first brushes being formed of electrographite brush material having a high content of copper powder, said second brushes being formed of an electrographite rush material having a high content of carbon powder.

2. A starting system for an internal combustion engine, comprising:

a D.C. motor, including a rotary drive shaft having a first end and a second end opposite said first end, rotatable in opposite first and second rotational directions, a commutator, first brushes and second brushes axially aligned with said second brushes with respect to said shaft, in sliding contact with said commutator, said first brushes being formed of electrographite brush material having a high content of copper powder, said second brushes being formed of an electrographite brush material having a high content of carbon powder, and means for energizing said motor to rotate said shaft in said first rotational direction by applying a supply voltage to said first brushes and to rotate said shaft in said second rotational direction by applying the supply voltage to said second brushes, said energizing means including means for reversing the rotational direction of said shaft by alternatively applying the supply voltage to said first brushes or to said second brushes, with opposite polarities to respective aligned ones of said first brushes and second brushes;

a pinion mounted on said first end of said shaft so as to be meshingly engagable with a ring gear of the engine for rotatively driving the ring gear when said shaft is rotated in said first rotational direction; and a one-way clutch mounted to said second end of said shaft, having means for engaging a load device for rotatively driving the load device only when said shaft is rotated in said second rotational direction opposite said first rotational direction.

* * * * *